US007436111B2

(12) United States Patent
Hwang

(10) Patent No.: US 7,436,111 B2
(45) Date of Patent: Oct. 14, 2008

(54) ELECTRON EMISSION DEVICE

(75) Inventor: Seong-Yeon Hwang, Suwon-si (KR)

(73) Assignee: Samsung SDI Co. Ltd., Suwon-si (KR)

( * ) Notice: Subject to any disclaimer, the term of this patent is extended or adjusted under 35 U.S.C. 154(b) by 623 days.

(21) Appl. No.: 11/137,462

(22) Filed: May 25, 2005

(65) Prior Publication Data

US 2005/0264171 A1 Dec. 1, 2005

(30) Foreign Application Priority Data

May 28, 2004 (KR) ..... 10-2004-0038163

(51) Int. Cl.
*H01J 1/62* (2006.01)

(52) U.S. Cl. ..... 313/497; 313/306; 313/308; 313/310; 313/326

(58) Field of Classification Search ..... None
See application file for complete search history.

(56) References Cited

U.S. PATENT DOCUMENTS 5,786,656 A * 7/1998 Hasegawa et al. ..... 313/308
5,789,857 A * 8/1998 Yamaura et al. ..... 313/495
2004/0036409 A1 * 2/2004 Oh et al. ..... 313/495
2004/0174110 A1 * 9/2004 Ito ..... 313/310

* cited by examiner

*Primary Examiner*—Ashok Patel
(74) *Attorney, Agent, or Firm*—Christie, Parker & Hale, LLP

(57) ABSTRACT

An electron emission display device is capable of focusing electrons emitted from an electron emission region by using small gate holes formed on a thick insulating layer. The electron emission device includes a substrate, a cathode electrode formed on the substrate, a insulating layer formed on the cathode electrode, a gate electrode formed on the insulating layer, and the electron emission region formed on the cathode electrode. In the electron emission device, the insulating layer is provided with a first insulating layer and at least one second insulating layer formed partly on the first insulating layer, and the gate electrode has a stepped portion along a surface of the insulating layer and an inclined portion to connect upper and lower end portions of the stepped portion. As such, with above-structured electron emission device, the inclined portion of the gate electrode formed at the periphery of the gate hole can focus the electrons emitted from the electron emission portion so that the contrast and the coloration are enhanced to realize high definition images without a separate or distinct focusing electrode (e.g., a grid electrode, a grid plate, etc.).

13 Claims, 8 Drawing Sheets

ELECTRON EMISSION DEVICE

CROSS REFERENCE TO RELATED APPLICATION

This application claims priority to and the benefit of Korean Patent Application No. 10-2004-0038163 filed on May 28, 2004 in the Korean Intellectual Property Office, the entire content of which is incorporated herein by reference.

FIELD OF THE INVENTION

The present invention relates to an electron emission display device, and in particular, to an electron emission display device which is capable of focusing electrons emitted from an electron emission region with a small gate hole formed on a thick insulating layer.

BACKGROUND OF THE INVENTION

Generally, electron emission display devices can be classified into two types. A first type uses a hot (or thermoionic) cathode as an electron emission source, and a second type uses a cold cathode as the electron emission source.

Also, in the second type of electron emission display devices, there are a field emission array (FEA) type, a surface conduction emitter (SCE) type, a metal-insulator-metal (MIM) type, a metal-insulator-semiconductor (MIS) type, and a ballistic electron surface emitting (BSE) type.

Although the electron emission display devices are differentiated in their specific structures depending upon their type, they all basically have an electron emission unit placed within a vacuum vessel, and a light emission unit facing the electron emission unit in the vacuum vessel.

In the FEA electron emission display device, driving voltages are applied to the driving electrodes placed around the electron emitters to form electric fields, and electrons are emitted from the electron emitters due to the electric fields.

In order to make electrodes form electric fields around a FEA electron emission region (or electron emitters), it has been proposed that a printed film insulating layer located between cathode and gate electrodes be made thicker. This proposal has an advantage in that it is simple, can print to a large area, and provides a thick (and robust) insulating layer, as compared to a thin film printing technique.

However, since a gate hole may be formed by a wet etching technique, which depends on the characteristic of the printed insulating layer, and since the gate hole may have the electron emission region formed therein, there can be a problem in that the wet etching technique is not suitable to make a small and uniform gate hole due to an instability of such an etching technique.

Also, in an FEA electron emission device, since gate electrodes at a periphery of a gate hole may improperly affect electrons emitted from the electron emission region, the emitted electrons may arc toward an anode electrode. Because of this, there can be a problem in that the electrons fail to reach the intended phosphor portion, thereby resulting in a reduction of picture quality of the FEA electron emission device.

SUMMARY OF THE INVENTION

In one aspect of the present invention, an electron emission device is provided with a thick insulating layer that is capable of enhancing a dielectric characteristic as well as forming a small gate hole.

In another aspect of the present invention, an electron emission device is capable of focusing an electron beam emitted from an electron emission region toward an intended phosphor portion by reforming a structure of a gate electrode.

In one exemplary embodiment of the present invention, an electron emission device includes a substrate, a plurality of cathode electrodes formed on the substrate in a first direction, a insulating layer formed on the cathode electrodes, a plurality of gate electrodes formed on the insulating layer in a second direction, and a plurality of electron emission regions formed on at least one of the cathode electrodes. In the exemplary embodiment, the insulating layer is provided with a first insulating layer and at least one second insulating layer formed partly on the first insulating layer, and at least one of the gate electrode has a stepped portion along a surface of the insulating layer and an inclined portion to connect the upper and lower end portions of the stepped portion.

The first insulating layer may have a first width portion of a desired size, the second insulating layer may have a second width portion, and the second width portion may have a larger width than a width of the desired size. The gate hole may be formed in a rectangular shape or an elliptical shape.

A depth of the first insulating layer and a depth of the second insulating layer may be determined such that a ratio of a first height from the electron emission portion to the top of the second width portion and a second height from the electron emission portion to the top of the first width portion is not less than 1.5.

A sum of the depth of the first insulating layer and the depth of the second insulating layer may be determined such that the first height from the electron emission portion to the top of the shape width portion is not less than 4 μm.

The stepped portion may be formed along the first direction (e.g., a longitudinal direction of the at least one of the cathode electrodes), a second stepped portion may be formed along the second direction (e.g., a width direction of the at least one of the cathode electrodes), and the stepped portion formed along the first direction may have a height differing from a height of the second stepped portion formed along the second direction. The height of the stepped portion formed along the first direction may be smaller than the height of the second stepped portion formed along the second direction. The stepped portion may be formed only along the second direction.

The stepped portion and a corresponding stepped portion may be formed at both ends of a pixel along the second direction.

The electron emission region may be made from a carbon-based material, a carbon nanotube material, a graphite material, a diamond material, a diamond-like carbon material, and/or a $C_{60}$ (Fullerene) material.

In one exemplary embodiment of the present invention, an electron emission device includes a first substrate and a second substrate facing one another and having a predetermined gap therebetween, a plurality of cathode electrode formed on the first substrate, a insulating layer formed on the cathode electrodes, a plurality of gate electrodes formed on the insulating layer, a plurality of electron emission regions formed on the cathode electrodes, and an image display unit formed on the second substrate to display images by the electrons emitted from the electron emission region. In this embodiment, the insulating layer is provided with a first insulating layer and at least one second insulating layer formed partly on the first insulating layer, and the gate electrode has a stepped portion along the surface of the insulating layer and an inclined portion to connect the upper and lower end portions of the stepped portion.

The image display unit may include an anode electrode formed on the second substrate and a phosphor layer formed on a surface of the anode electrode. The anode electrode may have a transparent film or a metal film.

In one exemplary embodiment of the present invention, a method for manufacturing an electron emission display device includes: forming a cathode electrode in a predetermined pattern on a first substrate; printing a non-photoresistive dielectric paste over the cathode electrode and the first substrate to form a first insulating layer; printing a photoresistive paste on the first insulating layer to form a second insulating layer; exposing and developing the second insulating layer along a mask pattern having a hole larger than a desired size of a gate hole to partly expose the first insulating layer; forming a gate electrode on the first and second insulating layers; etching the gate electrode and the first and second insulating layers along a mask pattern having an intended size of the gate hole to form the gate hole; and forming at least one electron emission portion in the gate hole.

The exposing and developing the second insulating layer to partly expose the first insulating layer may form a hole having a size larger than the desired size of the gate hole in the second insulating layer along a first direction of the cathode electrode (or a longitudinal direction of the cathode electrode), and may forms the hole about the same size as the desired size in the first insulating layer along a second direction of the cathode electrode (or a width direction of the cathode electrode).

In one embodiment of the present invention, a method for manufacturing an electron emission display device includes: forming a cathode electrode in a predetermined pattern on a first substrate; printing a photoresistive dielectric paste over the cathode electrode and the first substrate to form a first insulating layer; printing a photoresistive paste on the first insulating layer; exposing and developing the first insulating layer along a mask pattern having a hole larger than a desired size of a gate hole to partly expose the cathode electrode; firing the first insulating layer after exposing and developing to form a inclined surface; printing a non-photoresistive paste on the first insulating layer and the cathode electrode to form a second insulating layer; forming gate electrodes along a surface of the second insulating layer; etching the gate electrodes and the first and second insulating layers along a mask pattern having the desired size of the gate hole to form the gate hole; and forming at least one electron emission portion in the gate hole.

On printing the non-photoresistive paste on the first insulating layer and the cathode electrode to form a second insulating layer, the non-photoresistive dielectric paste may be printed to a depth at an upper surface of the first insulating layer and an upper surface of the cathode electrode and an inclined side surface of the first insulating layer so as to form a stepped portion of the electron emission device.

The non-photoresistive dielectric paste may include materials having about 50° C. lower firing temperature than that of the photoresistive dielectric paste.

In one embodiment of the present invention, a method for manufacturing an electron emission display device includes: forming a cathode electrode in a predetermined pattern on a first substrate; printing a photoresistive paste over the cathode electrode and the first substrate to form a first insulating layer; exposing and developing the first insulating layer along a mask pattern having a hole larger than a desired size of a gate hole to partly expose a cathode electrode; printing a non-photoresistive paste on the first insulating layer and the cathode electrode to form a second insulating layer; forming gate electrodes along a surface of the second insulating layer; etching the gate electrodes and the first and second insulating layers along a mask pattern having a desired size of the gate hole to form the gate hole; and forming at least one electron emission portion in the gate hole.

The non-photoresistive dielectric paste may include materials having about 50° C. lower firing temperature than that of the photoresistive dielectric paste

BRIEF DESCRIPTION OF THE DRAWINGS

The accompanying drawings, which together with the specification illustrate exemplary embodiments of the present invention, and, together with the description, serve to explain the principles of the present invention.

DETAILED DESCRIPTION

Figure 1:
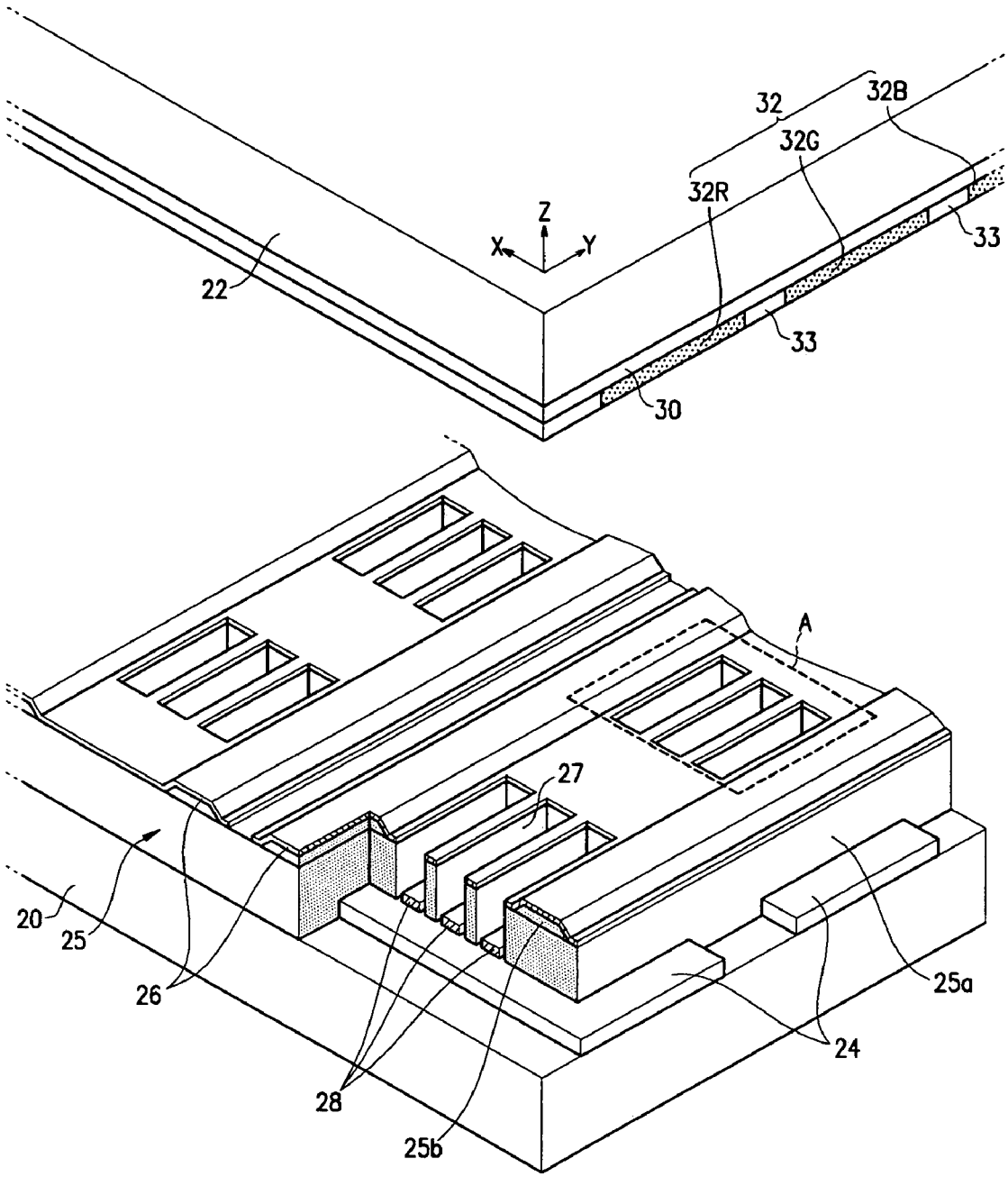
FIG. 1 is a partial exploded perspective view of an electron emission device according to an embodiment of the present invention.

Exemplary embodiments of the present invention will now be described in detail with reference to the accompanying drawings.

With reference to FIG. 1 to FIG. 4, the electron emission device according to the present invention is constructed as a vacuum vessel by joining a first substrate 20 and a second substrate 22 parallel to one another with a predetermined gap therebetween. A plurality of cathode electrodes 24 are formed on the first substrate 20, and a plurality of electron emission regions 28 are formed on the cathode electrode 24.

Gate electrodes 26, each having stepped portions and an inclined portion along the width-direction of the cathode electrodes 24 (or along the Y-direction of the cathode electrode 24) are formed crossing the X-direction of the cathode electrodes 24.

Further, an insulating layer 25 is formed between the cathode electrodes 24 and gate electrodes 26, and the insulating layer 25 is provided with a first insulating layer 25*a* and at least one second insulating layer 25*b* formed partly on the first insulating layer. The first insulating layer 25*a* has a predetermined depth (e.g., D1), and the second insulating layer 25*b* has a lesser depth (e.g., D2) than the depth (e.g., D1) of the first insulating layer 25*a*. Gate holes 27, each defined as a space housing the electron emission region 28, are formed in a predetermined pattern through the above insulating layer 25 that is formed between the cathode electrodes 24 and the gate electrodes 26.

Figure 2:
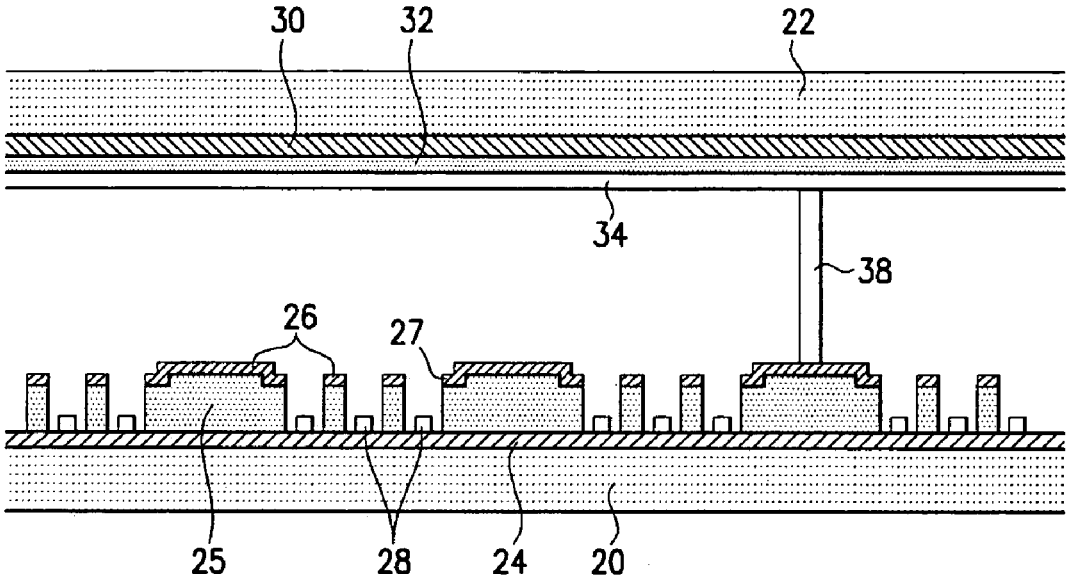
FIG. 2 is a partial exploded cross-sectional view of the electron emission device of FIG. 1.

Also, anode electrode(s) 30 are formed on the second substrate 22, and a phosphor layer 32 is formed on a surface of the anode electrode(s) 30. In FIGS. 1 and 2, the phosphor layer 32 is shown to be formed on the surface of the anode electrode(s) 30 facing the first substrate 20, but the invention is not thereby limited. For example, a phosphor layer maybe formed on a surface of the anode electrode(s) 30 facing away from the first substrate 20.

The cathode electrodes 24 are formed in a stripe pattern along the X-direction of the FIG. 1, and the gate electrodes 26 are formed in a stripe pattern along the Y-direction of the FIG. 1.

Pixel regions are defined by the "intersections" or "crossings" of the cathode electrodes 24 and the gate electrodes 26.

At least one electron emission region 28 is formed along a length (or X-direction) of the cathode electrode 24 corresponding to the location of the pixels.

Electron emission materials of the electron emission regions 28 include one or more carbon-based materials such as carbon nanotube, graphite, diamond, diamond-like carbon, $C_{60}$ (Fullerene), and the like, and/or nanometer-sized materials such as carbon nanotube, graphite nanofiber, silicon nanowire, and the like.

The carbon-based materials may efficiently emit electrons at a relative lower voltage ranging from about 10 to about 100V. Particularly, carbon nanotubes have been considered as an ideal electron emission source in that the carbon nanotubes have a extremely fine curvature of radius ranging from a few to a few tens of nm at a distal end thereof, and they efficiently emit electrons at a relatively low electric field ranging from about 1 to about 10 V/μm. The electron emission portion 28 may be formed in the shape of a cone, a wedge, a thin film edge, etc.

Further, at least one gate hole 27 is formed through at least one of the gate electrodes 26 and the insulating layer 25 corresponding to the same, to expose at least one of the electron emission regions 28 therethrough. In one embodiment, each of the holes formed on the insulating layer 25 and the gate electrode 26 is referred to as a gate hole 27.

The anode electrodes 30 formed on the second substrate 22 may be made from a transparent conductive film such indium tin oxide (ITO) or the like. The phosphor layer 32 formed on the second substrate 22 is composed of red phosphor layers 32R, green phosphor layers 32G, and blue phosphor layers 32B arranged alternately with a predetermined gap therebetween along a direction (e.g., the X-direction of the FIG. 1) of the cathode electrode 24 as shown in FIG. 1. Also, black layers 33 are formed between each of the phosphor layers 32R, 32G, and 32B so as to enhance a contrast.

Further, a metal film 34 such as an aluminum (Al) film may be deposited on the phosphor layers 32R, 32G, and 32B and the black layers 33 as shown in FIG. 2, The metal film 34 is for increasing a high potential voltage characteristic and screen brightness.

In an alternative embodiment, without ITO transparent anode electrodes, the phosphor layers 32 and black layers 33 may be directly formed on the second substrate 22, with the metal film 34 formed over the phosphor layers 32 and black layers 33 (rather than also over the ITO transparent anode electrodes 30 on the second substrate 22). In this alternative embodiment, the metal film may act as an anode electrode when a high voltage is applied thereto. As such, this alternative embodiment can withstand a higher voltage to enhance screen brightness as compared to the structure having a transparent electrode as the anode electrode on the second substrate 22 (and without the metal film 34).

The first substrate 20 and the second substrate 22 structured as in the above are sealed together using a sealant such as a frit in a state where these two substrates face one another with a predetermined gap therebetween. Then, the air between these two substrates is exhausted to form a vacuum therebetween, thereby completing the electron emission device.

In order to maintain a uniform gap between the first and second substrates 20, 22, spacers 38 are mounted in the predetermined gap between the first and second substrates 20,22. The spacers 38 should be mounted in non-pixel regions rather than in paths of the electron beam.

Figure 3:
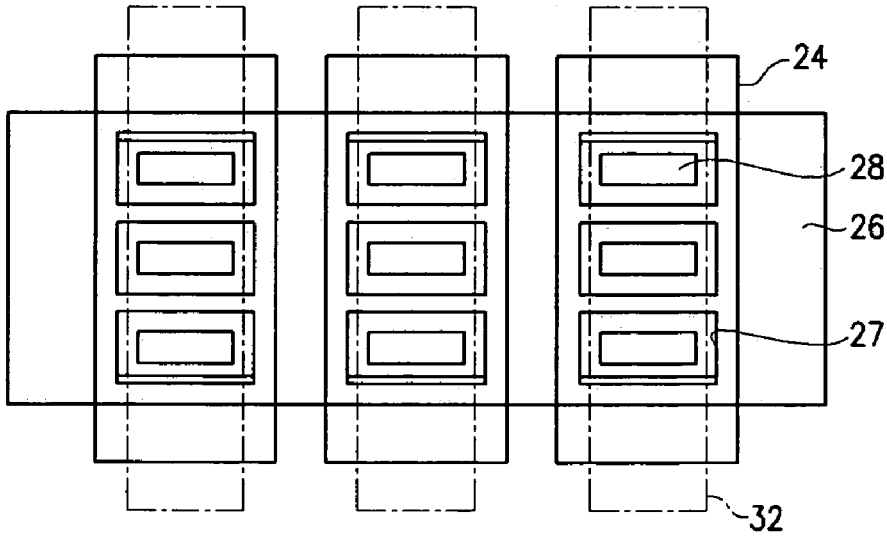
FIG. 3 is a partial exploded plan view of the electron emission device of FIG. 1.

Although not shown in FIG. 1 to FIG. 3, a focusing electrode or grid plate having a plurality of electron holes may also be provided between the first and second substrates 20 and 22, so as to enhance a focus performance of the electrons emitted from the electron emission region 28 and to protect the electric field of the anode electrode 30 from affecting each portion of the gate electrodes 26 and the cathode electrodes 24.

Figure 4:
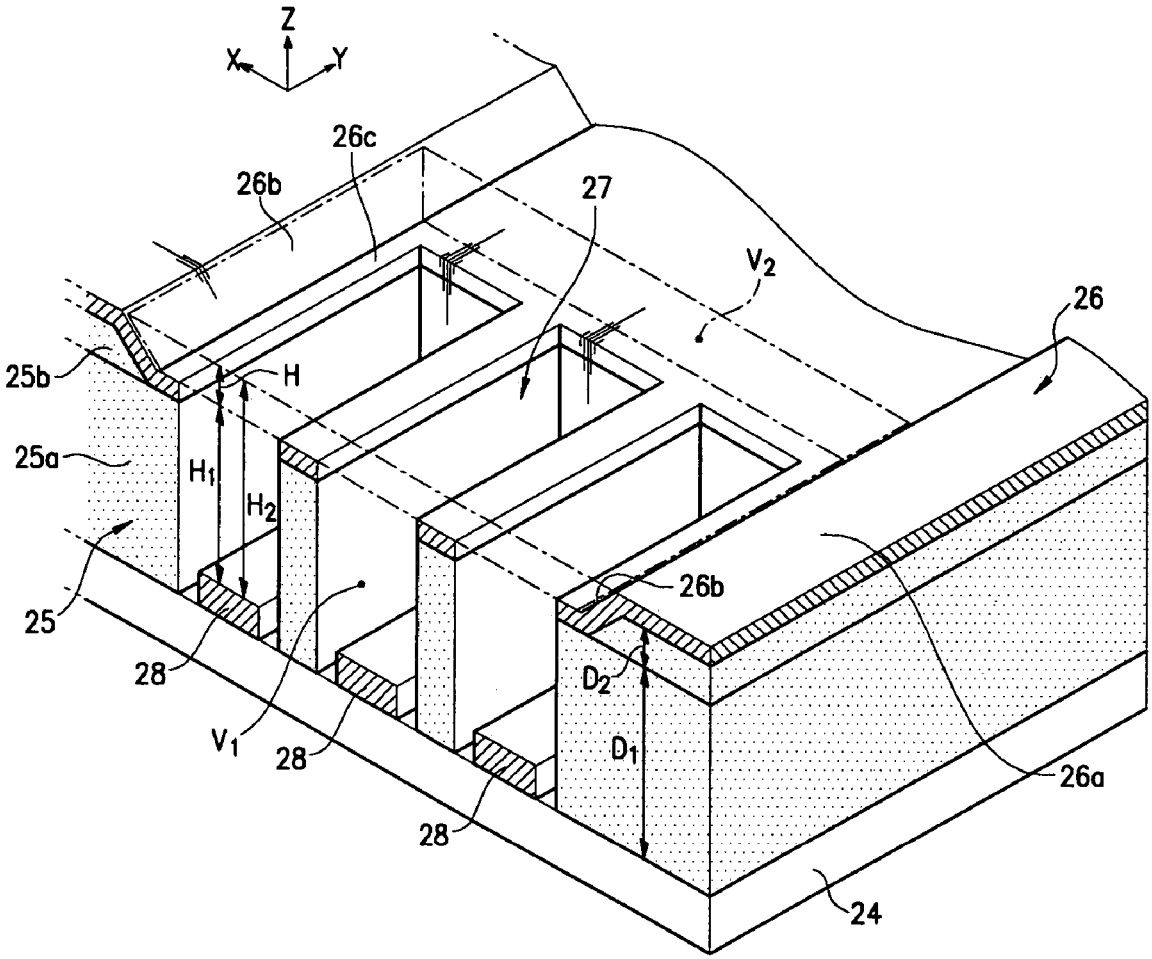
FIG. 4 is an exploded perspective view taken along portion A drawn as a dotted line in FIG. 1 according to a first embodiment of the present invention.
Figure 5:
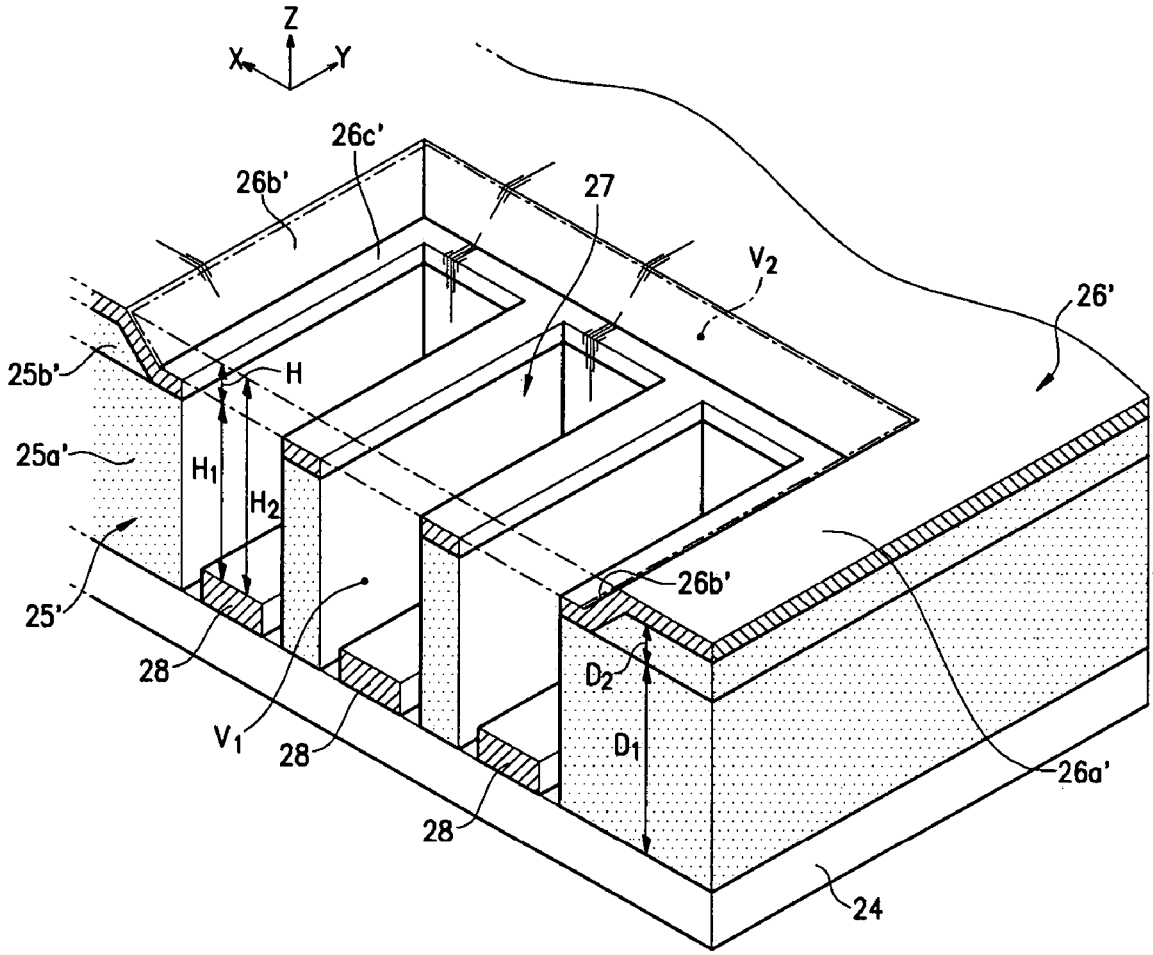
FIG. 5 is an exploded perspective view illustrating an alternative embodiment of FIG. 4.
Figure 6:
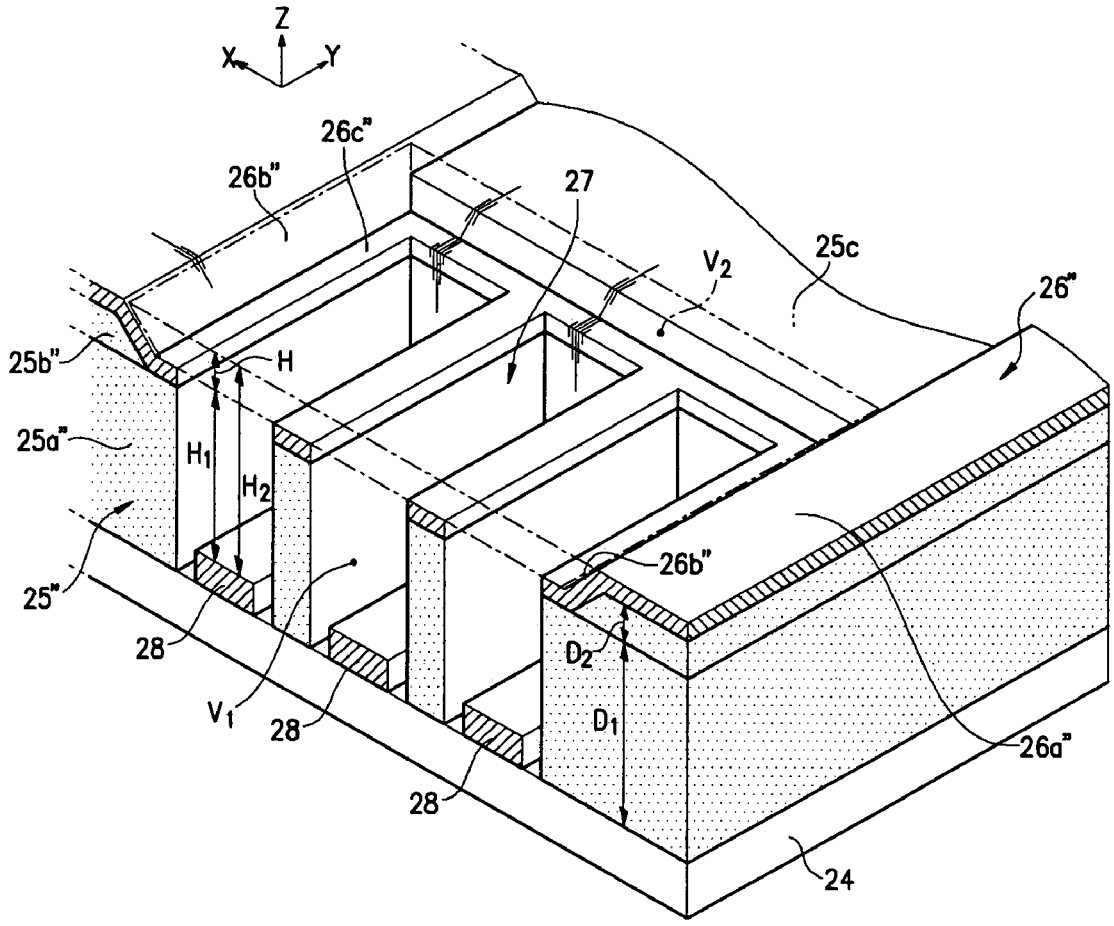
FIG. 6 is an exploded perspective view illustrating another alternative embodiment of FIG. 4.

The structure of a gate electrode (e.g., one of the gate electrodes 26) according to certain exemplary embodiments of the present invention will now be described in detail with reference to FIG. 4 to FIG. 6. FIG. 4 is an exploded perspective view taken along portion A drawn as a dotted line in FIG. 1; FIG. 5 is an exploded perspective view illustrating one alternative embodiment of FIG. 4; and FIG. 6 is an exploded perspective view illustrating another alternative embodiment of FIG. 4. The embodiments of FIGS. 5 and 6 may be used in place of and/or in addition to the embodiment of FIG. 4. In addition, the embodiments of FIG. 4 though FIG. 6 are provided for exemplary purposes, and the present invention is not thereby limited.

The insulating layer 25 includes a first insulating layer 25*a* having a predetermined depth D1, and at least one second insulating layer 25*b* formed partly on the first insulating layer, as shown in FIG. 4.

A smaller width portion V1 having a width corresponding to the intended size of the gate hole 27 is formed along the width-direction (X-direction of FIG. 1) at the first insulating layer 25*a*. The smaller width portion V1 has at least one gate hole 27 formed therein. Meanwhile, the second insulating layer 25*b* is formed along the width direction of the first insulating layer 25*a* to a predetermined depth D2 to supply sufficient dielectric at the periphery of the gate hole 27.

When the gate electrode 26 of a uniform depth is formed on the insulating layer 25, the gate electrode 26 has stepped portions 26*a* and 26*c* formed along the profile of the insulating layer 25 having different depths D1, D2, and an inclined portion 26*b* connecting the upper stepped portion 26*a* and the lower stepped portion 26*c*. A larger width portion V2 is formed with the periphery area of the gate holes 27 bordered on two ends by the inclined portion 26*b*.

In more detail, the larger width portion V2 is formed with the area bordered on two ends by the upper stepped portion 26*a* and delineated by the chain double-dashed line from the top of the smaller width portion V1 having a width corresponding to the intended size of the gate holes 27. As shown in FIG. 4, the width portion V2 slopes larger toward the upper stepped portion 26*a* from the smaller width portion V1. The smaller width portion V1 is formed with the area ranging from the bottom of the gate holes 27 accommodating the electron emission regions 28 to the top of the first insulating layer 25*a*.

The smaller width portion V1 has a height H1 corresponding to the depth of the first insulating layer 25*a*. The height is measured vertically from the top of the emission portion 28. Since the height H1 of the smaller width portion V1 is shorter than the height H2 of the larger width portion V2, the smaller width portion V1 is formed by wet etching the first insulating layer 25*a*. That is, since the gate hole 27 is formed at the first layer 25*a* that has a first depth D1 of the insulating layer 25, the gate hole 27 can be formed with a relative low aspect ratio. The second insulating layer 25*b* has the depth D2 from the top of the smaller width portion V1 to the top of the larger width portion V2, and the gate electrodes 26 are printed on the second insulating layer 25*b*. Also, an inclined portion 26*b* is formed with the same depth along the inclined portion of the second insulating layer 25*b* during firing of the second insulating layer 25*b*, the inclined portion 26*b* is formed at the periphery of the gate hole 27. The inclined portion 26*b* has a height H ranging to the top of the larger width portion V2 from the top of the smaller width portion V1, and is formed at the side of the larger width portion V2. Accordingly, the larger width portion V2 includes the inclined portion 26*b* so that it can act to focus the electron beam emitted from the electron emission portion 28.

Also, in order to form the structure of the gate electrode 26 having the stepped portions 26*a* and 26*c* and the inclined portion 26*b* to be capable of having a relatively smaller gate hole 27 at the smaller width portion V1 and focusing the electron beam, the insulating layer 25 has the first and second insulating layers 25*a* and 25*b* respectively formed with the depths D1 and D2 such that the height H2 ranging to the top of the larger width portion V2 is higher than the height H1 ranging to the top of the smaller width portion V1. In one embodiment, the heights H1 and H2 satisfy the relation $H2 \geqq 1.5 \times H1$. Also, the sum of the depths D1 and D2 and/or the height H2 ranging to the top of the larger width portion V2 may be set at about 4 μm so that the insulating layer 25 is sufficiently thick. In one embodiment, the sum of the depths D1 and D2 is determined such that the height is not less than 4 μm. That is, since the inclined portion 26*b* of the gate electrode 26 corresponding to the second insulating layer 25*b* can now isolate (shield and/or focus) the path of the electron beam advancing toward the phosphor layer 32, the electron beam suitably reaches the phosphor layer 32 at a point corresponding to the desired pixel. As a result, the focusing effect of the electron beam reaching the desired pixel may still increase while the anode electrode 30 may be driven at a relatively low voltage. In addition, the electron beam is now protected from reaching a neighboring phosphor layer 32 so that the contrast and the coloration increase.

In order to control the path of the electron beam emitted from the longitudinal or width direction of the cathode electrode 24, the shape of the gate hole 27 may be formed in a square shape, a rectangular shape, an ellipse shape, etc.

Referring to FIG. 5, in the structure of a gate electrode 26 according to an alternative exemplary embodiment of the present invention, the second insulating layer 25*b*' is formed along the longitudinal direction and the width direction of the cathode electrode 24. The gate electrode 26' has the stepped portions 26*a*', 26*c*' and the inclined portion 26*b*' along the profile of the insulating layer 25'. Referring also to FIG. 6, in another alternative exemplary embodiment, the gate electrode 26" is printed along the surface of the second insulating layer 25*b*" with the same depth, as is shown in FIG. 6. In FIGS. 5 and 6, the stepped portions 26*a*', 26*c*', 26*a*", 26*c*" and the inclined portion 26*b*', 26*b*" are formed at both ends along the longitudinal direction and at the width direction of the gate hole 27.

The stepped portions 26*a*',26*c*', 26*a*", 26*c*" may be formed to different heights at the width direction and/or the longitudinal direction of the cathode electrode 24. The insulating layer 25', 25" may be provided with the first insulating layer 25*a*', 25*a*" formed on the cathode electrode 24, the second insulating layer 25*b*', 25*b*" formed on the first insulating layer 25*a*', 25*a*" along the width direction of the cathode electrode 24, and a third insulating layer 25*c* (as shown in FIG. 6) formed on the first insulating layer 25*a*', 25*a*" along the longitudinal direction of the cathode electrode 24.

The fundamental structure shown in FIGS. 5 and/or 6 is similar to the structure shown in FIG. 4 in that at least one smaller width portion V1 is formed at the first insulating layer 25*a*', 25*a*", and the larger width portion V2 formed with the stepped portions 26*a*', 26*c*', 26*a*", 26*c*" and the inclined portion 26*b*', 26*b*" is formed such that the larger width portion V2 has its width slopping upward starting from the top of the smaller width portion V1. In addition, the black layers 33 (shown in FIG. 1) may also be formed along the longitudinal direction of the cathode electrode 24 so as to further prevent the electron beam from reaching a neighboring phosphor layer.

Also, in both stepped portions 26*a*', 26*c*', 26*a*", 26*c*" of the gate electrode 26', 26" along the width direction of the cathode electrode 24, the insulating layer 25', 25" has the first and second insulating layers 25*a*', 25*b*', 25*a*", 25*b*" respectively formed with the depths D1 and D2 such that the height H2 ranging to the top of the larger width portion V2 is higher than the height H1 ranging to the top of the smaller width portion V1. In one embodiment, the heights H1 and H2 are satisfied by the relation $H2 \geqq 1.5 \times H1$. Also, the sum of the depths D1 and D2 and/or the height H2 ranging to the top of the larger width portion V2 may be set as about 4 μm so that the insulating layer 25 is sufficiently thick. In one embodiment, the sum of the depths D1 and D2 is determined such that the height is not less than 4 μm.

A method of manufacturing the electron emission display device according to one exemplary embodiment of the present invention will be now explained with reference to FIGS. 4 and 7 for exemplary purpose. However, the method of FIG. 7 is not limited to manufacturing the embodiment of FIG. 4 and, for example, may be used to manufacture the embodiments of FIGS. 5 and 7.

Figure 7:
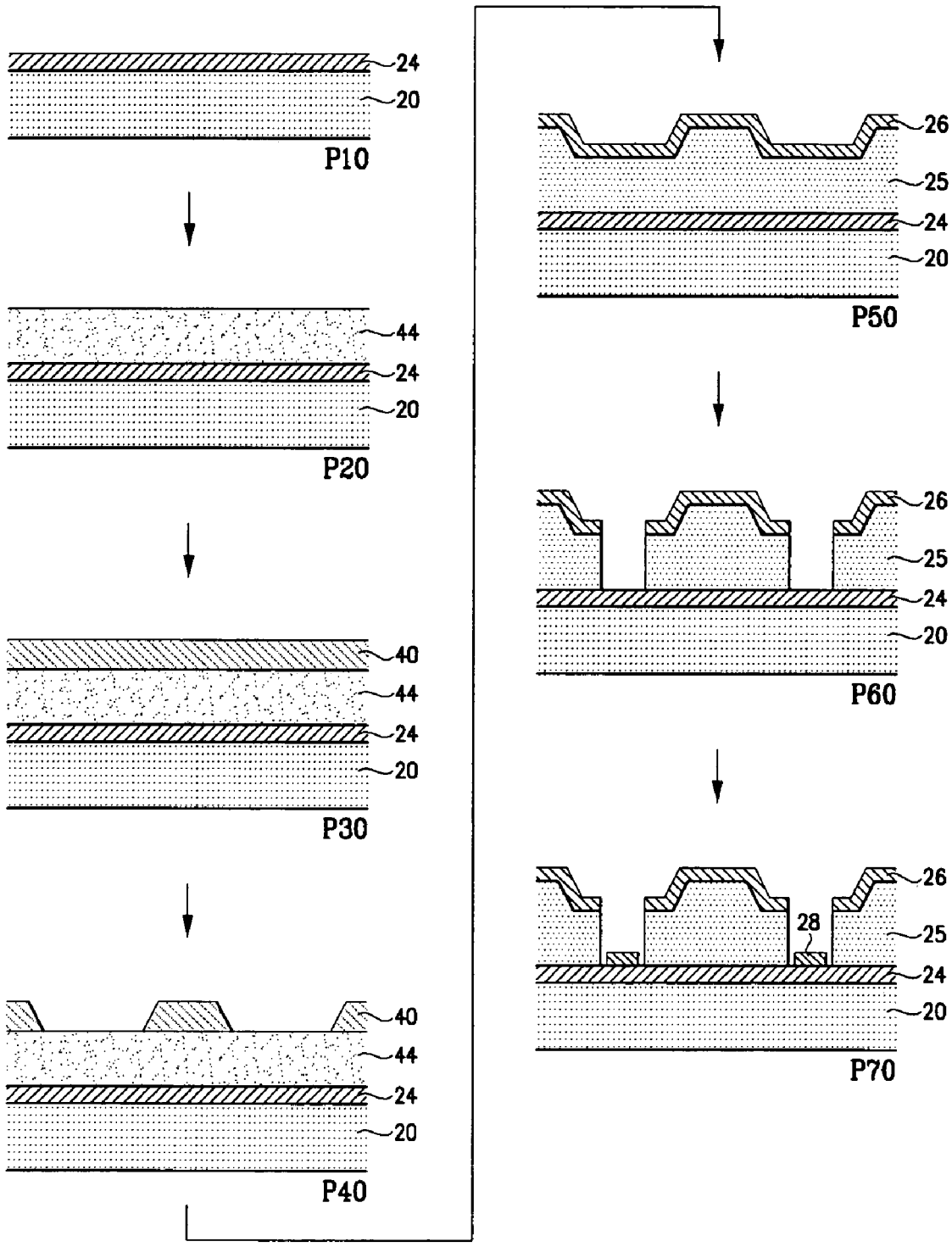
FIG. 7 is a flow chart illustrating one exemplary embodiment of a method for manufacturing an electron emission device according to the present invention.

As shown in FIG. 7, the method includes: forming (P10) cathode electrodes 24 in a predetermined pattern on the first substrate 20; printing (P20) non-photoresistive pastes on the cathode electrodes 24 and the first substrate 20 to form a first insulating layer 44; printing (P30) photoresistive pastes on the first insulating layer 44 to form a second insulating layer 40; exposing and developing (P40) the second insulating layer 40 along a mask pattern with a hole larger than the desired size of a gate hole 27 (not shown) to expose a portion of the first insulating layer 44 corresponding to the gate hole 27 to thereby form the insulating layer 25; forming (P50) gate electrodes 26 in a predetermined pattern on the insulating layer 25; etching (P60) the gate electrodes 26 and the insulating layer 25 along a mask pattern to form the gate hole 27 at its desired size; and forming (P70) the electron emission portion 28 on the cathode electrode 24 in the gate hole 27.

When exposing and developing (P40) the second insulating layer 40, hole patterns having a size larger than the desired size of the gate hole 27 are etched along the longitudinal direction of the cathode electrode 24, and hole patterns having the same or about the same size as the desired size of the gate hole 27 are etched along the width direction of the cathode electrode 24. In one embodiment, the exposing and developing (p40) the second insulating layer 40 forms a hole having a size larger than the desired size of the gate hole 27 in the second insulating layer 25*b* along a longitudinal direction of the cathode electrode 24, and forms the hole about the same size as the desired size in the first insulating layer 25*a* along a width direction of the cathode electrode 24.

In forming the insulating layer 25, the first insulating layer 44 remains exposed at the periphery of the gate hole 27 along the longitudinal direction of the cathode electrode 24, and the second insulating layer 40 exists at the periphery of the gate hole 27 along the width direction of the cathode electrode 24 so that the depth of the insulating layer 25 is different according to the longitudinal or width direction of the cathode electrode 24. The second insulating layer made from the photoresistive paste may be developed by using a 0.4% solution of $Na_2CO_3$.

The gate electrode 26 is formed with a thin film by sputtering, and/or other suitable method so that hole patterns of the gate electrode 26 can be precisely formed.

The cathode electrode 24 may be formed with an ITO thin film by sputtering and/or other suitable method. The depth of the cathode electrode 24 may be set in a range from about 1,000 to 3,000 Å or more by considering a resistance value and/or other suitable values. If a large cathode electrode 24 is to be formed, the cathode electrode 24 should have a low resistance. Accordingly, to provide the low resistance, an embodiment includes a bus electrode made from a low resistance material, such as Au, Ag, Al, etc., that is stacked with the cathode electrode.

Figure 8:
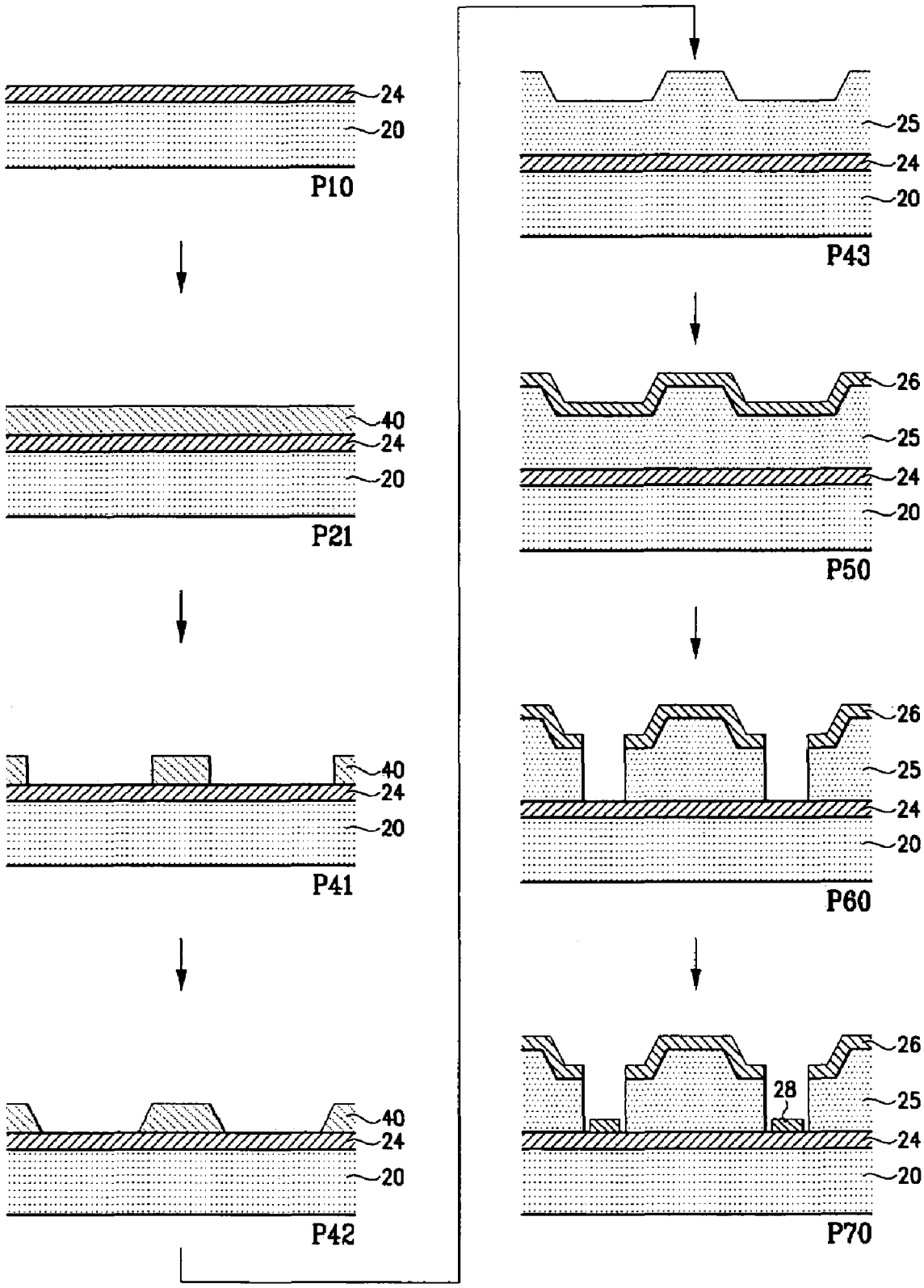
FIG. 8 is a flow chart illustrating another exemplary embodiment of a method for manufacturing an electron emission device according to the present invention.

A method of manufacturing the electron emission display device according to another embodiment of the present invention is shown in FIG. 8, The method includes: forming (P10) cathode electrodes 24 in a predetermined pattern on the first substrate 20; printing (P21) photoresistive pastes on the cathode electrodes 24 and the first substrate 20 to form the first insulating layer 44; exposing and developing (P41) the first insulating layer 44 along a mask pattern with a hole larger than the desired size of the gate hole 27 to expose the portion of the cathode electrode 24 corresponding to the gate hole 27; firing (P42) the first insulating layer 44 to form the inclined surface at the side thereof; printing (P43) non-photoresistive pastes on the first insulating layer 44 and the cathode electrode 24 to form the insulating layer 25; forming (P50) gate electrodes 26 in a predetermined pattern on the insulating layer 25; etching (P60) the gate electrodes 26 and the insulating layer 25 along a mask pattern with the desired size of the gate hole 27 to form the gate hole 27; and forming (P70) the electron emission portion 28 on the cathode electrode in the gate hole 27.

In one embodiment, the firing temperature of the non-photoresistive dielectric paste is about 50° C. less than the firing temperature of the photoresistive dielectric paste to form the first insulating layer 44 such that the pattern of the first insulating layer 44 arranged thereunder remains.

Figure 9:
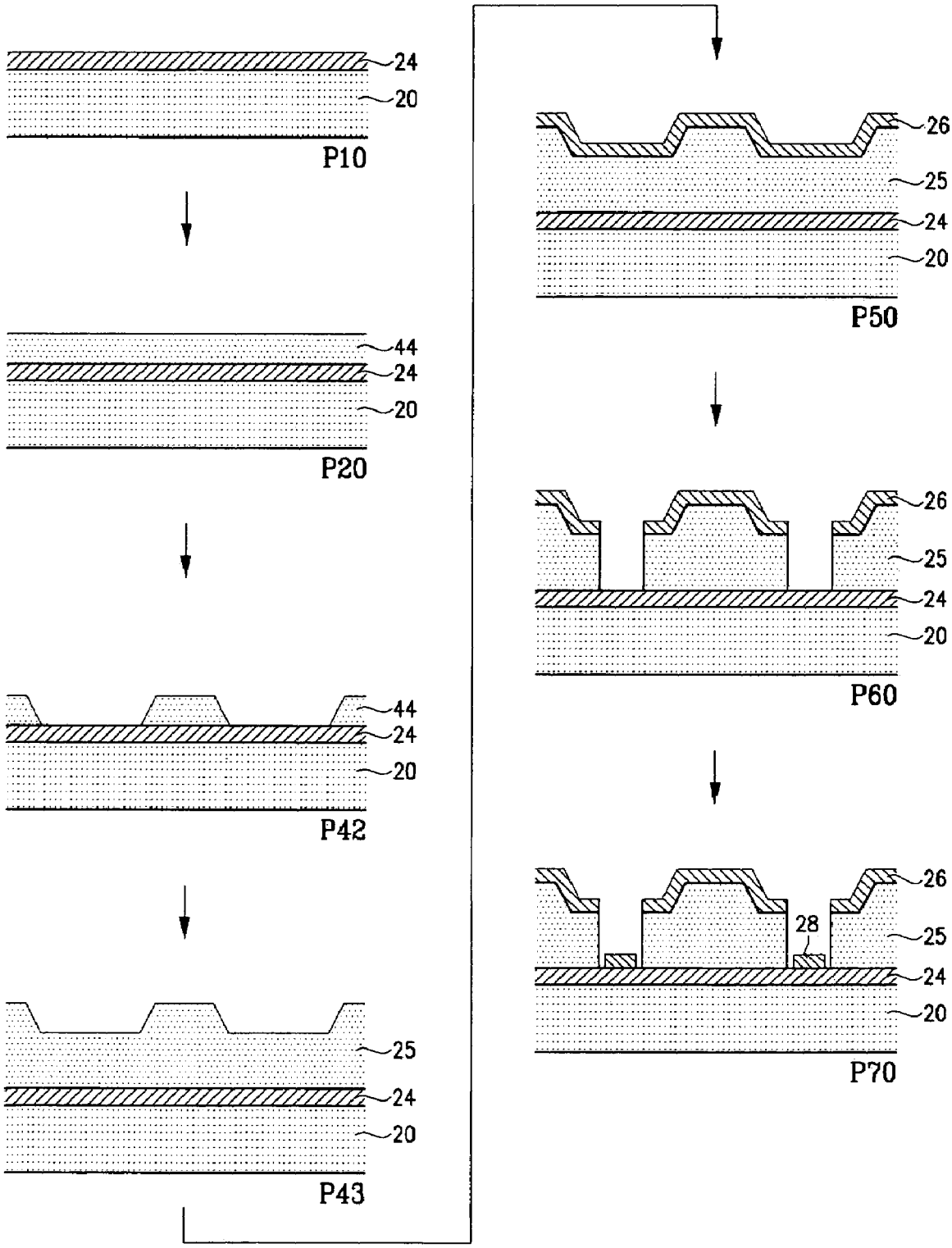
FIG. 9 is a flow chart illustrating yet another exemplary embodiment of a method for manufacturing an electron emission device according to the present invention.

A method of manufacturing the electron emission display device according to another embodiment of the present invention is shown in FIG. 9 The method includes: forming (P10) cathode electrodes 24 in a predetermined pattern on the first substrate 20; printing (P20) photoresistive pastes on the cathode electrodes 24 and the first substrate 20 to form a first insulating layer 44; exposing and developing (P42) the first insulating layer 44 along the mask pattern with a hole larger than the desired size of the gate hole 27 to expose the portion of the cathode electrode 24 corresponding to the gate hole 27; printing (P43) non-photoresistive pastes on the first insulating layer 44 and cathode electrode 24 to form the insulating layer 25; forming (P50) gate electrodes 26 in a predetermined pattern on the insulating layer 25; etching (P60) the gate electrodes 26 and the insulating layer 25 along the mask pattern with the hole of the desired size of the gate hole 27 to form the gate hole 27; and forming (P70) the electron emission portion 28 on the cathode electrode in the gate hole 27.

In one embodiment, the firing temperature of the non-photoresistive dielectric paste is about 50° C. less than the firing temperature of the photoresistive dielectric paste to form the first insulating layer 44 such that the pattern of the first insulating layer 44 arranged thereunder remains.

In view of the foregoing, an electron emission device of the present invention includes an inclined portion of a gate electrode formed at a periphery of a gate hole that can focus the electrons emitted from an electron emission portion so that a contrast and a coloration is enhanced to realize the high definition images without addition of a separate or distinct focusing electrode (e.g., a grid electrode, a grid plate, etc.).

Also, with an above-structured electron emission device, the distance to the portion of the gate electrode arranged along the width direction of a cathode electrode from the electron emission portion (or phosphor layer) is relatively long while the distance to the portion of the gate electrode arranged along the longitudinal direction of the cathode electrode (or phosphor layer) from the electron emission portion is relative short so that beam spreading to the neighboring phosphor layer can be hindered.

Further, with an above-structured electron emission device, since the depth of the insulating layer can be thin at the portion where the gate hole is formed, the gate hole can be formed with a relatively small aspect ratio so that the distance from the electron emission portion to the gate electrode is short, thereby reducing the driving voltage of the gate electrode and power consumption.

In addition, with an above-structured electron emission device, since the single insulating layer is formed at the portion having a thin depth and at least two insulating layers are formed at the portion having a thick depth, it is easy to form the insulating layer having the different depths and it is also possible to form a gate hole having a small size.

Further, with an above-structured electron emission device, by appropriately combining the photoresistive paste and the non-photoresistive paste, the thick insulating layer can be formed simply, the process time can be shortened, and an inexpensive apparatus can be used despite the thick insulating layer. And, since it is impossible for the width of the gate hole to be enlarged by the undercut during the etching process, the density of the gate holes per pixel is increased thereby realizing high definite pixels and high definition images.

While this invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission device comprising:

a substrate;

a plurality of cathode electrodes formed on the substrate in a first direction;

a insulating layer formed on the cathode electrodes;

a plurality of gate electrodes formed on the insulating layer in a second direction;

a plurality of electron emission regions formed on at least one of the cathode electrodes, wherein the insulating layer is provided with a first insulating layer and at least one second insulating layer formed partly on the first insulating layer, and wherein at least one of the gate electrodes has a stepped portion and an inclined portion to connect upper and lower end portions of the stepped portion.

2. The electron emission display device of claim 1, wherein the first insulating layer has a first width portion of a desired size and the second insulating layer has a second width portion, and wherein the second width portion has a larger width than a width of the desired size.

3. The electron emission display device of claim 2, wherein the first width portion comprises a gate hole formed through the insulating layer and through which at least one of the electron emission portions is exposed.

4. The electron emission display device of claim 2, wherein a depth of the first insulating layer and a depth of the second insulating layer are determined such that a ratio of a first height from the electron emission portion to the top of the second width portion and a second height from the electron emission portion to the top of the first width portion is not less than 1.5.

5. The electron emission display device of claim 4, wherein a sum of the depth of the first insulating layer and the depth of the second insulating layer is determined such that the first height from the electron emission portion to the top of the second width portion is not less than 4 μm.

6. The electron emission display device of claim 2, wherein the stepped portion is formed along the first direction and further comprising a second stepped portion formed along the second direction, wherein the stepped portion formed along the first direction has a height differing from a height of the second stepped portion formed along the second direction.

7. The electron emission display device of claim 6, wherein the height of the stepped portion formed along the first direction is smaller than the height of the second stepped portion formed along the second direction.

8. The electron emission display device of claim 1, wherein the stepped portion is formed only along the second direction.

9. The electron emission display device of claim 1, wherein the stepped portion and a corresponding stepped portion is formed at both ends of a pixel along the second direction of the at least one of the cathode electrode.

10. The electron emission display device of claim 1, wherein at least one of the electron emission regions comprises a carbon-based material, a carbon nanotube material, a graphite material, a diamond material, a diamond-like carbon material, and/or a $C_{60}$ (Fullerene) material.

11. An electron emission device comprising:

a first substrate and a second substrate facing one another and having a predetermined gap therebetween;

a plurality of cathode electrodes formed on the first substrate;

a insulating layer formed on the cathode electrodes;

a plurality of gate electrodes formed on the insulating layer;

a plurality of electron emission regions formed on the cathode electrodes; and an image display unit formed on the second substrate to display images by the electrons emitted from the electron emission regions, wherein the insulating layer is provided with a first insulating layer and at least one second insulating layer formed partly on the first insulating layer, and wherein a gate electrode has a stepped portion along the surface of the insulating layer and an inclined portion to connect upper and lower end portions of the stepped portion.

12. The electron emission display device of claim 11, wherein the image display unit includes an anode electrode formed on the second substrate and a phosphor layer formed on a surface of the anode electrode.

13. The electron emission display device of claim 12, wherein the anode electrode has a transparent film or a metal film.

* * * * *